United States Patent [19]

Ghandehari

[11] Patent Number: 4,933,009

[45] **Date of Patent: * Jun. 12, 1990**

[54] COMPOSITION FOR PREPARING RARE EARTH-IRON-BORON-PERMANENT MAGNETS

[75] Inventor: Mohammad H. Ghandehari, Brea, Calif.

[73] Assignee: Union Oil Company of California, Los Angeles, Calif.

[ * ] Notice: The portion of the term of this patent subsequent to May 31, 2005 has been disclaimed.

[21] Appl. No.: 201,943

[22] Filed: Jun. 3, 1988

Related U.S. Application Data

[62] Division of Ser. No. 745,293, Jun. 14, 1985, Pat. No. 4,762,574.

[51] Int. Cl.[5] ..... H01F 1/09

[52] U.S. Cl. ..... 75/252; 75/254; 148/302

[58] Field of Search ..... 148/103, 105, 302; 420/83; 75/252, 254

[56] References Cited

U.S. PATENT DOCUMENTS

| | | | |
|---|---|---|---|
| 3,887,395 | 6/1975 | Martin | 148/103 |
| 4,133,680 | 1/1979 | Babaskin et al. | 420/83 |
| 4,135,953 | 1/1979 | Nagel et al. | 148/103 |
| 4,747,874 | 5/1988 | Ghandehari | 75/254 |
| 4,769,063 | 9/1988 | Ishigaki et al. | 148/302 |
| 4,770,702 | 9/1988 | Ishigaki et al. | 420/83 |

FOREIGN PATENT DOCUMENTS

| | | |
|---|---|---|
| 83106573 | 2/1984 | European Pat. Off. . |
| 83107351 | 5/1984 | European Pat. Off. . |

OTHER PUBLICATIONS

A. L. Robinson, "Powerful New Magnet Material Found", *Science,* vol. 223, pp. 920–922 (1984).

M. Sagawa, S. Fujimura, N. Togawa, H. Yamamoto, and Y. Matsuura, "New Material for Permanent Magnets on a Base of Nd and Fe", *Journal of Applied Physics,* vol. 55, pp. 2083–2087 (1984).

M. Sagawa, S. Fujimura, H. Yamamoto, Y. Matsuura, and K. Hiraga, "Permanent Magnet Materials Based on the Rare Earth-Iron-Boron Tetragonal Compounds", *IEEE Transactions on Magnetics,* vol. MAG-20, Sep. 1984, pp. 1584–1589.

C. Herget, "Metallurgical Ways to NdFeB Alloys. Permanent Magnets from Co-Reduced NdFeB", presented at the 8th International Workshop on Rare-Earth Magnets and their Applications, Dayton, Ohio, May 6–8, 1985.

*Primary Examiner*—Theodore Morris
*Assistant Examiner*—George Wyszomierski
*Attorney, Agent, or Firm*—Alan H. Thompson; Gregory F. Wirzbicki

[57] ABSTRACT

Permanent magnets are prepared by a method comprising mixing a particulate rare earth-iron-boron alloy with a particulate rare earth oxide, aligning the magnetic domains of the mixture, compacting the aligned mixture to form a shape, and sintering the compacted shape.

15 Claims, No Drawings

COMPOSITION FOR PREPARING RARE EARTH-IRON-BORON-PERMANENT MAGNETS

This application is a division, of application Ser. No. 745,293, filed June 14, 1985 now U.S. Pat. No. 4,762,574.

BACKGROUND OF THE INVENTION

1. Field of the Invention

The invention pertains to powder metallurgical compositions and methods for preparing rare earth-iron-boron permanent magnets, and to magnets prepared by such methods.

2. Description of the Art

Permanent magnets (those materials which exhibit permanent ferromagnetism) have, over the years, become very common, useful industrial materials. Applications for these magnets are numerous, ranging from audio loudspeakers to electric motors, generators, meters, and scientific apparatus of many types. Research in the field has typically been directed toward developing permanent magnet materials having ever-increasing strengths, particularly in recent times, when miniaturization has become desirable for computer equipment and many other devices.

The more recently developed, commercially successful permanent magnets are produced by powder metallurgy sintering techniques, from alloys of rare earth metals and ferromagnetic metals. The most popular alloy is one containing samarium and cobalt, and having an empirical formula $SmCo_5$. Such magnets also normally contain small amounts of other samarium-cobalt alloys, to assist in fabrication (particularly sintering) of the desired shapes.

Samarium-cobalt magnets, however, are quite expensive, due to the relative scarcity of both alloying elements. This factor has limited the usefulness of the magnets in large volume applications such as electric motors, and has encouraged research to develop permanent magnet materials which utilize the more abundant rare earth metals, which generally have lower atomic numbers, and less expensive ferromagnetic metals. The research has led to very promising compositions which contain neodymium, iron, and boron in various proportions. Progress, and some predictions for future utilities, are given for compositions described as $R_2Fe_{14}B$ (where R is a light rare earth) by A. L. Robinson, "Powerful New Magnet Material Found," *Science,* Vol. 223, pages 920–922 (1984).

Certain of the compositions have been described by M. Sagawa, S. Fujimura, N. Togawa, H. Yamamoto, and Y. Matsuura "New Material for Permanent Magnets on a Base of Nd and Fe," *Journal of Applied Physics,* Vol. 55, pages 2083–2087 (1984). In this paper, crystallographic and magnetic properties are reported for various $Nd_xB_yFe_{100-x-y}$ compositions, and a procedure for preparing permanent magnets from powdered $Nd_{15}B_8Fe_{77}$ is described. The paper discusses the impairment of magnetic properties which is observed at elevated temperatures and suggests that additions of small amounts of cobalt to the alloys can be beneficial in avoiding this impairment.

Additional information about the compositions is provided by M. Sagawa, S. Fujimura, H. Yamamoto, Y. Matsuura, and K. Hiraga, "Permanent Magnet Materials Based on the Rare Earth-Iron-Boron Tetragonal Compounds," *IEEE Transactions on Magnetics,* Vol. MAG-20, Sept. 1984, pages 1584–1589. Small additions of terbium or dysprosium are said to increase the coercivity of neodymium-iron-boron magnets; a comparison is made between $Nd_{15}Fe_{77}B_8$ and $Nd_{13.5}Dy_{1.5}Fe_{77}B_8$ magnets.

SUMMARY OF THE INVENTION

One aspect of the invention is a method for producing rare earth-iron-boron permanent magnets, comprising the steps of: (1) mixing a particulate alloy containing at least one rare earth metal, iron, and boron, with at least one particulate rare earth oxide; (2) aligning magnetic domains of the mixture in a magnetic field; (3) compacting the aligned mixture to form a shape; and (4) sintering the compacted shape. Preferably, the rare earth oxide is one or more of the heavy lanthanide oxides. The alloy can be a mixture of rare earth-iron-boron alloys and, in addition, a portion of the iron can be replaced by another ferromagnetic metal, such as cobalt. This invention also encompasses compositions for use in the method, and products produced thereby.

DETAILED DESCRIPTION OF THE INVENTION

As used herein, the term "rare earth" includes the lanthanide elements having atomic numbers from 57 through 71, plus the element yttrium, atomic number 39, which is commonly found in certain lanthanide-containing ores and is chemically similar to the lanthanides.

The term "heavy lanthanide" is used herein to refer to those lanthanide elements having atomic numbers 63 through 71, excluding the "light rare earths" with atomic numbers 62 and below.

"Ferromagnetic metals" include iron, nickel, cobalt, and various alloys containing one or more of these metals. Ferromagnetic metals and permanent magnets exhibit the characteristic of magnetic hysteresis, wherein plots of induction versus applied magnetic field strengths (from zero to a high positive value, and then to a high negative value and returning to zero) are hysteresis loops.

Points on the hysteresis loop which are of particular interest for the present invention lie within the second quadrant, or "demagnetization curve," since most devices which utilize permanent magnets operate under the influence of a demagnetizing field. On a loop which is symmetrical about the origin, the value of field strength (H) for which induction (B) equals zero is called coercive force ($H_c$). This is a measure of the quality of the magnetic material. The value of induction where applied field strength equals zero is called residual induction ($B_r$). Values of H will be expressed in Oersteds (Oe), while values of B will be in Gauss (G). A figure of merit for a particular magnet shape is the energy product, obtained by multiplying values of B and H for a given point on the demagnetization curve and expressed in Gauss-Oersteds (GOe). When these unit abbreviations are used, the prefix "K" indicates multiplication by $10^3$, while "M" indicates multiplication by $10^6$. When the energy products are plotted against B, one point ($BH_{max}$) is found at the maximum point of the curve; this point is also useful as a criterion for comparing magnets. Intrinsic coercivity ($iH_c$) is found where (B-H) equals zero in a plot of (B-H) versus H.

The present invention is a method for preparing permanent magnets based upon rare earth-iron-boron alloys, which invention also includes certain compositions useful in the method and the magnets prepared thereby. This method comprises mixing a particulate rare earth-iron-boron alloy with a particulate rare earth oxide, before the magnetic domain alignment, shape-forming, and sintering steps are undertaken.

Copending U.S. patent application Ser. No. 595,290, filed March 30, 1984 by the present inventor, describes an improvement in coercivity which is obtained in rare earth-ferromagnetic metal alloy magnets, by a method which involves the addition of a particulate refractory oxide, carbide, or nitride to alloy powders, before forming magnets. The method is exemplified by magnet compositions based upon $PrCo_5$ and is found to be particular effective when compounds such as $Cr_2O_3$, MgO, and $Al_2O_3$ are used as additives.

However, it has now been discovered that these compounds which are particularly effective with rare earth-ferromagnetic metal alloy magnets do not appear to function in the same manner with neodymium-iron-boron magnets, but actually can tend to degrade the magnetic properties.

Suitable rare earth-iron-boron alloys for use in this invention include those discussed in the previously noted paper by Robinson, those by Sagawa et al., as well as others in the art. Magnets currently being developed for commercialization generally are based upon neodymium-iron-boron alloys, but the present invention is also applicable to alloy compositions wherein one or more other rare earths, particularly those considered to be light rare earths, replaces all or some fraction of the neodymium. In addition, a portion of the iron can be replaced by one or more other ferromagnetic metals, such as cobalt.

The alloys can be prepared by several methods, with the most simple and direct method comprising melting together the component elements, e.g., neodymium, iron, and boron, in the correct proportions. Prepared alloys are usually subjected to sequential particle size reduction operations, preferably sufficient to produce particles of less than about 200 mesh (0.075 millimeter diameter).

To the magnet alloy powder is added rare earth oxide, preferably having particle sizes and distributions similar to those of the alloy. Oxide can be mixed with alloy after the alloy has undergone particle size reduction, or can be added during size reduction, e.g., while the alloy is present in a ball mill. The alloy and oxide are thoroughly mixed and this mixture is used to prepare magnets by the alignment, compaction, and sintering steps.

The rare earth oxide additive can be a single oxide or a mixture of oxides. Particularly preferred are oxides of the heavy lanthanides, especially dysprosium oxide and terbium oxides (appearing to function similarly to dysprosium and terbium metal additions, which were reported by Sagawa et al. in the *IEEE Transactions on Magnetics,* discussed supra). Suitable amounts of rare earth oxide are about 0.5 to about 10 weight percent of the magnet alloy powder; more preferably about 1 to about 5 weight percent is used.

While it is not intended to be bound in any manner by a particular theory, it is possible that the rare earth oxide reacts at particle grain boundaries with the rare earth metal of the magnet alloy. Using dysprosium oxide and a neodymium-iron-boron alloy as examples, this reaction could form dysprosium metal and neodymium oxide at the alloy particle grain boundaries. However, even if dysprosium metal is formed, the present invention offers advantages over the direct addition of dysprosium metal into the magnet alloy, including: (1) dysprosium oxide is much less expensive than dysprosium metal; and (2) thorough blending of powders is significantly easier than blending molten metals.

As a further advantage, it has now been discovered that oxide addition can simplify subsequent heat treatment requirements for sintered magnet shapes. To obtain the highest quality neodymium-iron-boron sintered magnets, a two-stage heat treatment (or annealing) procedure, after sintering, has been found advantageous; this may require heating, for example, about 900° C. for about 2 hours, followed by heating about 650° C. to 700° C. for about 2 hours. With added rare earth oxide, however, the heat treatment can be reduced to a single step, about 630° C. to 900° C. for about 2 hours, while still producing quality magnets (although, in some cases, additional improvements in magnetic properties can be obtained by further heat treatments).

Certain of these benefits, excluding the cost advantage, can be obtained by adding powdered rare earth metal to the particles of magnet alloy. Again, the heavy lanthanides are preferred, with dysprosium and terbium being especially preferred. Particle sizes and distributions are preferably similar to those of the magnet alloy, and a simple mixing of the alloy powder and additive metal powder precedes the alignment, compaction, and sintering steps for magnet fabrication.

The powder mixture is placed in a magnetic field to align the crystal axes and magnetic domains, preferably simultaneously with a compacting step, in which a shape is formed from the powder. This shape is then sintered to form a magnet having good mechanical integrity, under conditions of vacuum or an inert atmosphere (such as argon). Typically, sintering temperatures about 1060° C. to about 1100° C. are used.

By use of the invention, permanent magnets are obtained which have increased coercivity, over magnets prepared without added rare earth oxide or rare earth metal powders. This is normally accompanied by a decrease in magnet residual induction, but nonetheless makes the magnet more useful for many applications, including electric motors.

The invention will be further described by the following examples, which are not intended to be limiting, the invention being defined solely by the appended claims. In these example, all percentage compositions are expressed on a weight basis.

EXAMPLE 1

An alloy having the nominal composition 33.5% Nd-65.2% Fe-1.3% B is prepared by melting together elemental neodymium, iron, and boron in an induction furnace, under an argon atmosphere. After the alloy is allowed to solidify, it is heated at about 1070° C. for about 96 hours, to permit remaining free iron to diffuse into other alloy phases which are present. The alloy is cooled, crushed by hand tools to particle sizes less than about 70 mesh (0.2 millimeters diameter), and ball-milled under an argon atmosphere, in trichlorotrifluoroethane, to obtain a majority of particle diameters about 5 to 10 micrometers in diameter. After drying under a vacuum, the alloy is ready for use to prepare magnets.

Samples of the alloy powder are used to prepare magnets, using the following procedure:

(1) additive powders are weighed and added to weighed amounts of alloy powder;

(2) the mixture is vigorously shaken in a glass vial by hand for a few minutes, to intimately mix the components;

(3) magnetic domains and crystal axes are aligned by a transverse field of about 14.5 KOe while the powder mixture is being compacted loosely in a die, then the pressure on the die is increased to about 10,000 p.s.i.g. for 20 seconds;

(4) the compacted "green" magnets are sintered under argon at about 1070° C. for one hour and then rapidly moved into a cool portion of the furnace and allowed to cool to room temperature.

(5) cooled magnets are annealed at about 900° C. under argon for about 3 hours and then rapidly cooled in the furnace, as described above.

Properties of the prepared magnets are summarized in Table I. These data indicate that a rare earth oxide additive significantly improves coercivity of a neodymium-iron-boron magnet, while other inorganic oxides are quite detrimental to magnetic properties.

TABLE I

| Additive | | $B_r$ (Gauss × $10^3$) | $H_c$ (Oersted × $10^3$ | $iH_c$ (Oersted × $10^3$ | $BH_{max}$ (MGOe) |
|---|---|---|---|---|---|
| Formula | Wt. Percent | | | | |
| — | 0 | 11.8 | 5.5 | 6.5 | 28.0 |
| $Tb_4O_7$ | 4 | 11.0 | 9.0 | 13.5 | 27.5 |
| $Al_2O_3$ | 1 | 0 | 0 | 0 | 0 |
| MgO | 1 | 0 | 0 | 0 | 0 |

EXAMPLE 2

Magnets are prepared using the procedure of Example 1, except that annealing is conducted at about 830° C. for about 3.5 hours.

Table II summarizes the properties of these magnets. The data show the effects of various rare earth oxide additives, or a chromic oxide additive, on magnetic properties.

TABLE II

| Additive | | $B_r$ (Gauss × $10^3$) | $H_c$ (Oersted × $10^3$) | $iH_c$ (Oersted × $10^3$) | $BH_{max}$ (MGOe) |
|---|---|---|---|---|---|
| Formula | Wt. Percent | | | | |
| — | 0 | 12.0 | 6.6 | 7.8 | 32.5 |
| $Dy_2O_3$ | 3 | 11.2 | 8.3 | 9.9 | 30 |
| $Y_2O_3$ | 3 | 11.4 | 5.2 | 6.1 | 25.5 |
| $CeO_2$ | 3 | 10.6 | 6.1 | 7.2 | 24.5 |
| $Sm_2O_3$ | 3 | 9.3 | 3.3 | 3.8 | 12 |
| — | 0 | 12.0 | 6.6 | 7.8 | 33 |
| $Gd_2O_3$ | 3 | 11.4 | 6.7 | 8.0 | 31 |
| $Tb_4O_7$ | 3 | 11.3 | 9.5 | 11.4 | 30.5 |
| $Ho_2O_3$ | 3 | 11.2 | 6.7 | 8.0 | 28.5 |
| $Er_2O_3$ | 3 | 11.1 | 5.7 | 6.6 | 27 |
| $Cr_2O_3$ | 0.75 | 11.7 | 6.2 | 7.3 | 30 |
| — | 0 | 11.9 | 5.8 | 6.7 | 30 |
| $Tm_2O_3$ | 3 | 11.0 | 6.3 | 7.5 | 27 |
| $Yb_2O_3$ | 3 | 9.1 | 2.7 | 3.7 | 8 |

EXAMPLE 3

Dysprosium oxide-containing magnets are prepared, as in Example 1, except that annealing is at about 630° C. for about 2.5 hours.

Table III summarizes the properties of the prepared magnets, showing that increasing the concentration of the dysprosium oxide additive generally results in increased coercivity.

TABLE III

| $Dy_2O_3$ Added (Wt. Percent) | $B_r$ (Gauss × $10^3$) | $H_c$ (Oersted × $10^3$ | $iH_c$ (Oersted × $10^3$ | $BH_{max}$ (MGOe) |
|---|---|---|---|---|
| 0 | 12.3 | 9.0 | 11.6 | 35 |
| 2 | 11.4 | 10.7 | 13.5 | 31.5 |
| 0 | 12.2 | 8.7 | 10.6 | 35 |
| 1 | 11.8 | 10.0 | 12.3 | 34 |
| 3 | 11.5 | 11.0 | 14.7 | 32 |
| 4 | 11.0 | 10.6 | 16.0 | 29 |
| 4 | 11.2 | 10.8 | 16.0 | 31 |

EXAMPLE 4

A magnet alloy powder having the nominal composition 30% Nd-3.5% Dy-65.2% Fe-1.3% B is prepared by melting the elements together, as in Example 1, and is used to form a magnet by the procedure of Example 1, except that annealing is at about 630° C. for about 2.5 hours; this magnet is designated "A." Another magnet (Designated "B") is prepared, using a neodymium-iron-boron alloy powder similar to that of Example 1, with 4 percent dysprosium oxide added, and using a similar heat treatment to that used for magnet A.

Properties of the two magnets are summarized in Table IV, indicating that the conditions used to form a high-quality Nd-Fe-B magnet with added rare earth oxide are not the same as those needed when dysprosium is a component of the magnet alloy.

TABLE IV

| Magnet | $B_r$ (Gauss × $10^3$) | $H_c$ (Oersted × $10^3$ | $iH_c$ (Oersted × $10^3$ | $BH_{max}$ (MGOe) |
|---|---|---|---|---|
| A | 10.9 | 7.6 | 9.1 | 27 |
| B | 11.0 | 10.6 | 16.0 | 29 |

EXAMPLE 5

A magnet alloy powder having the nominal composition 30.5% Nd-3% Dy-65.2% Fe-1.3% B is prepared, as described in Example 1, and is used to prepare a magnet with the alignment, compaction, and sintering steps of that example.

After determining the magnetic properties of the magnet, it is subjected to annealing at about 900° C. for about 3 hours, then cooled to about 650° C. in the annealing furnace and rapidly cooled to room temperature; the magnetic properties are again measured. The magnet is again annealed, at about 670° C. for about 3 hours, then is quenched and the magnetic properties are measured.

Data obtained from the measurements are summarized in Table V. It is apparent that sequential heat treatments are necessary to prepare high-quality magnets, where a rare earth oxide has not been added to the magnet alloy. Note that magnet B of the preceding example is approximately equivalent in properties to the finally prepared magnet of the present example, but would be less expensive to produce, both for materials and for fabrication costs.

TABLE V

| Annealing Temp., °C. | $B_r$ (Gauss × $10^3$) | $H_c$ (Oersted × $10^3$ | $iH_c$ (Oersted × $10^3$ | $BH_{max}$ (MGOe) |
|---|---|---|---|---|
| None | 11.0 | 7.6 | 9.2 | 29 |
| 900 | 11.0 | 10.0 | 12.5 | 20 |
| 670 | 11.2 | 10.4 | 18.5 | 30 |

Various embodiments and modifications of this invention have been described in the foregoing description and examples, and further modifications will be apparent to those skilled in the art. Such modifications are included within the scope of the invention as defined by the following claims.

What is claimed is:

1. A composition for preparing permanent magnets comprising:

(a) a particulate alloy containing at least one rare earth metal, iron, and boron; and (b) at least one particulate rare earth oxide, said particulate rare earth oxide comprising about 0.5 to about 10 weight percent of said particulate alloy.

2. The composition defined in claim 1, wherein said rare earth metal is a light rare earth.

3. The composition defined in claim 2, wherein said rare earth metal is neodymium.

4. The composition defined in claim 3 wherein said particulate alloy has a nominal composition of $Nd_{15}B_8Fe_{77}$.

5. The composition defined in claim 1, wherein the alloy further contains a ferromagnetic metal selected from the group consisting of cobalt, nickel, and mixtures thereof.

6. The composition defined in claim 1, wherein said rare earth oxide is a heavy lanthanide oxide.

7. The composition defined in claim 6, wherein said heavy lanthanide oxide is selected from the group consisting of gadolinium oxide, terbium oxide, dysprosium oxide, holmium oxide, and mixtures thereof.

8. The composition defined in claim 7, wherein said heavy lanthanide oxide is selected from the group consisting of terbium oxide, dysprosium oxide, and mixtures thereof.

9. A composition for preparing rare earth-iron boron permanent magnets comprising:

(a) a particulate alloy containing at least one light rare earth metal, iron, and boron; and (b) at least one particulate heavy lanthanide oxide selected from the group consisting of terbium oxide, dysprosium oxide, and mixtures thereof, said particulate heavy lanthanide oxide comprising about 0.5 to about 10 weight percent of said particulate alloy.

10. The composition defined in claim 9 wherein said rare earth metal is neodymium.

11. The composition defined in claim 10 wherein the alloy further contains a ferromagnetic metal selected from the group consisting of cobalt, nickel, and mixtures thereof.

12. The composition defined in claim 11 wherein said particulate alloy has a nominal composition of $Nd_{15}B_8Fe_{77}$.

13. A composition for preparing neodymium-iron-boron permanent magnets comprising:

(a) a particulate alloy containing neodymium, iron, and boron; and (b) about 0.5 to about 10 weight percent of particulate dysprosium oxide.

14. The composition defined in claim 13 wherein the alloy further contains a ferromagnetic metal selected from the group consisting of cobalt, nickel, and mixtures thereof.

15. The method defined in claim 13 wherein said particulate alloy has a nominal composition of $Nd_{15}B_8Fe_{77}$.

* * * * *